United States Patent [19]

Haglund

[11] 4,236,139

[45] Nov. 25, 1980

[54] COIL ASSEMBLY

[75] Inventor: John H. Haglund, Danbury, Conn.

[73] Assignee: The Kanthal Corporation, Bethel, Conn.

[21] Appl. No.: 11,907

[22] Filed: Feb. 13, 1979

[51] Int. Cl.[3] ..... H01C 3/20

[52] U.S. Cl. ..... 338/302; 13/25; 219/534; 219/550; 336/207; 338/270

[58] Field of Search ..... 336/207, 185; 338/302, 338/304, 305, 299, 296, 286, 282, 278, 270, 269, 268, 267, 234, 235, 236, 237; 174/146; 13/25; 219/534, 555, 550, 554, 553

[56] References Cited

U.S. PATENT DOCUMENTS

| | | | |
|---|---|---|---|
| 1,426,940 | 8/1922 | Wulff | 336/185 |
| 1,535,859 | 4/1925 | Roothaan | 336/185 |
| 3,095,468 | 6/1963 | Klein | 174/146 X |

FOREIGN PATENT DOCUMENTS

| | | | |
|---|---|---|---|
| 1003368 | 2/1957 | Fed. Rep. of Germany | 336/207 |

*Primary Examiner*—Thomas J. Kozma
*Attorney, Agent, or Firm*—Kenyon & Kenyon

[57] ABSTRACT

A coil assembly is formed by an elastic metal wire helical extension spring coil having convolutions resiliently urged towards each other and held apart by spacers pinched between the convolutions and held there by the spring-back of the convolutions. The spacers can interspace the coil convolutions and be made to extend radially inwardly and outwardly beyond the inside and outside of the coil, so as to radially space the coil from a coil center and the inside of a tubular casing enclosing the coil. In this way a tubular radiant heater can be made by using electric resistance wire to form the coil and making the spacers from refractory insulating material.

3 Claims, 6 Drawing Figures

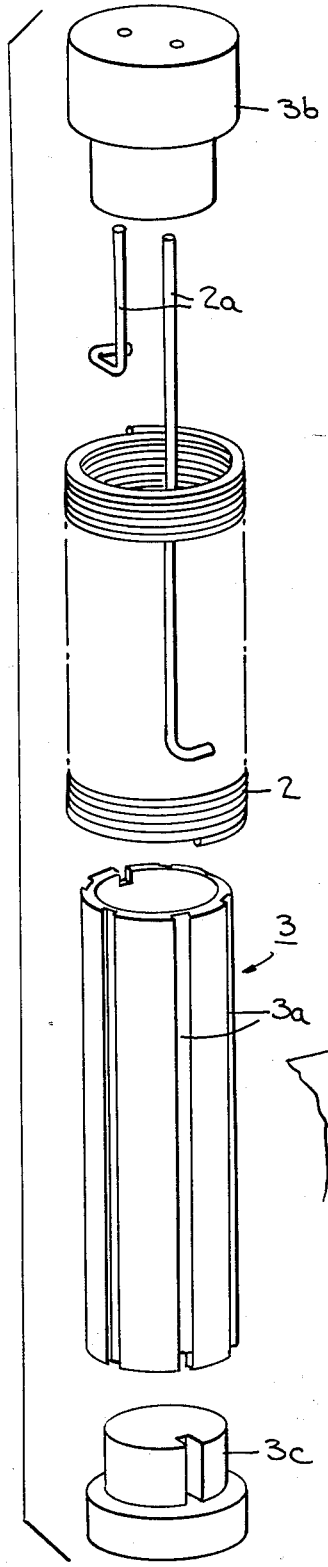
Fig. 2.
Fig. 5.
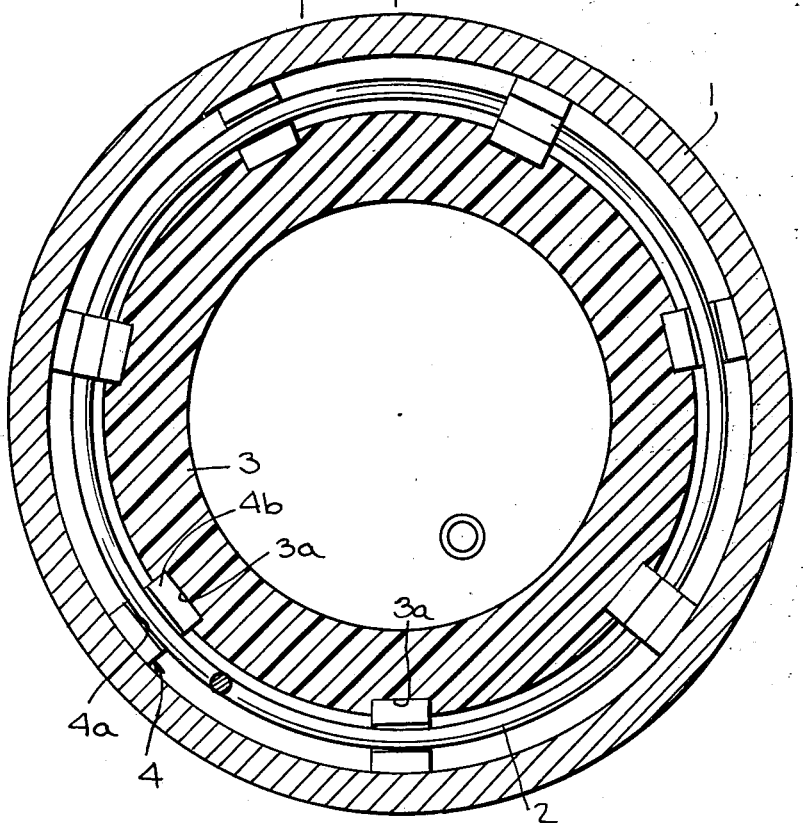
Fig. 3.
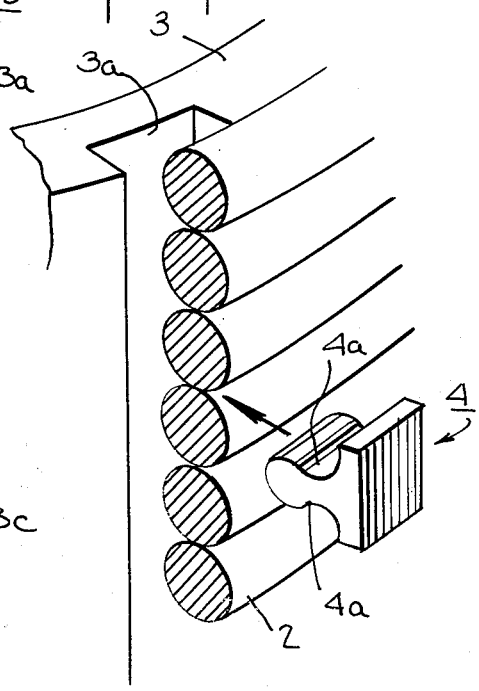
Fig. 4.
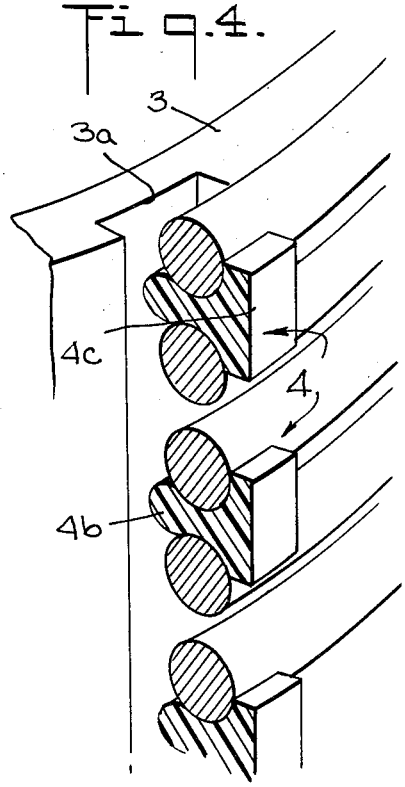

COIL ASSEMBLY

BACKGROUND OF THE INVENTION

It is commercially desirable to provide in the most economical way an assembly comprising a helical coil of strand, such as wire, with the coil convolutions separated from each other and positively held against displacement.

An example is a coil of electric resistance heating wire, such as might be used inside of a metal or refractory tube for heating the tube to form a radiant heater for use inside of industrial furnaces. Such a heater is normally required to use electric resistance wire of relatively heavy gauge, coiled in such a way that the coil convolutions are positively anchored in interspaced relationship, with the materials and manufacturing costs held at a minimum compatible with reliability.

The usual way for accomplishing this objective is to provide a refractory core that is helically grooved inwardly with the wire convolutions seated in these grooves. This is the accepted commercial practice, although other expedients have been proposed. There are objections to this practice.

One objection is that to fabricate the assembly, the wire or rod must be coiled with the convolutions separated and with the helical core grooves matching in pitch, the core then being screwed into the coil. This is objectionable from the manufacturing viewpoint concerning labor costs.

Another objection is that the refractory core must be a high-purity refractory such as substantially pure alumina, because otherwise the coil will chemically react with the electric resistance wire having the compositions often used. Such high-purity material is expensive.

SUMMARY OF THE INVENTION

According to the present invention, a coil assembly, particularly attractive in the case of a coil of electric resistance heating wire, is basically characterized by the wire being coiled so as to form what is, in effect, a substantially helical extension spring coil having convolutions resiliently urged towards each other. To this extent, it is similar to a mechanical helical extension spring coil such as is used in the mechanical arts. However, with this invention, the convolutions, inherently resiliently urged towards each other into intercontact or so closely so as to be impractical as an electric resistance wire heating coil, are held apart by spacers pinched between the convolutions and held by the spring-back of the convolutions.

In other words, assuming that electric resistance wire, which is elastic because made of metal, is helically coiled so that the convolutions normally intercontact or almost intercontact each other. This forms what is, in effect, a helical extension spring coil. Then, by stretching the coil, the convolutions are separated, spacers are inserted between the convolutions, and the coil then released with the spacers pinched and held positively in position. When the coil is electric resistance heating wire, the spacers should, of course, be made of an electrically insulating refractory and, keeping in mind the possibility of a chemical reaction between refractories and electrical resistance wire, these spacers should be made of high-purity material such as in the form of alumina commonly used when it must be in contact with such wire. However, these spacers can be made quite small, they can be formed by extrusion, cutting and subsequent firing, and they can be distributed throughout the coil in the form of axially extending rows which are circumferentially interspaced and preferably with the spacers of one row staggered axially with respect to those of another row. Only a small amount of the high cost refractory need to be used.

For positive radial holding, the spacers may be made with indents engaged by the convolutions. For axial rigidity of the coil, a refractory coil center can be inserted through the coil and against which the spacer bases radially rest. Because the spacers space the wire from the coil center, the latter may be made of any material that is adequately refractory. The coil center and coil are radially interspaced so there can be no chemical reaction between the two, permitting the coil center to be made of a relatively inexpensive refractory.

For use as a radiant heater in an industrial furnace, it is customary to use an electric resistance heating element inside of a heat-radiating tube made of metal or possibly a ceramic. The spacers can be formed to radially project beyond the outer surface of the coil so as to provide external bases which positively space the coil from the inside of such a tube. When the tube is metal, complete electrical isolation is provided for the coil; and if ceramic, the ceramic composition need not be selected to avoid chemical reaction with the wire. There is an annular space separating these components.

Preferably, when a center core is used, it is formed with axially extending recesses in which the spacer bases can be received so as to positively lock the spacers against circumferential shifting such as might occur due to rough handling or thermal effects even though the spacers are pinched tightly between the coil convolutions.

In the case of an electric resistance heater, if with service the electric resistance heating wire grows, the pinched spacers remain firmly positioned with the pinching effect possibly even being increased.

The Czepek U.S. Pat. No. 2,556,679 shows an electric resistance heating coil with spacers between the convolutions. However, in this case the coil is wound initially with its convolutions separated from each other, and the spacers are loosely inserted between the convolutions and are closely interspaced so as to, for practical purposes, close the helical spaces between the coil convolutions, an external packing of refractory material preventing the spacers from falling outwardly. This is an internal heater where the work to be heated is placed inside of the coil, whereas the present invention concerns an externally radiating heater.

BRIEF DESCRIPTION OF THE DRAWINGS

A specific example of this invention is illustrated by the accompanying drawings, in which:

FIG. 2 is an exploded perspective of the coil assembly per se, showing wire helically tightly coiled with its convolutions intercontacting together with the other components required for completion;

FIG. 3 on an enlarged scale, shows the tightly coiled wire and one of the spacers to be introduced between the coil convolutions when the coil is stretched for this operation;

FIG. 4 is the same as FIG. 3 but shows the coil convolutions with the spacers in position and held by being pinched between the coil convolutions;

FIG. 5 is a cross section taken on the line V—V in FIG. 1; and

DETAILED DESCRIPTION OF THE INVENTION

Figure 1:
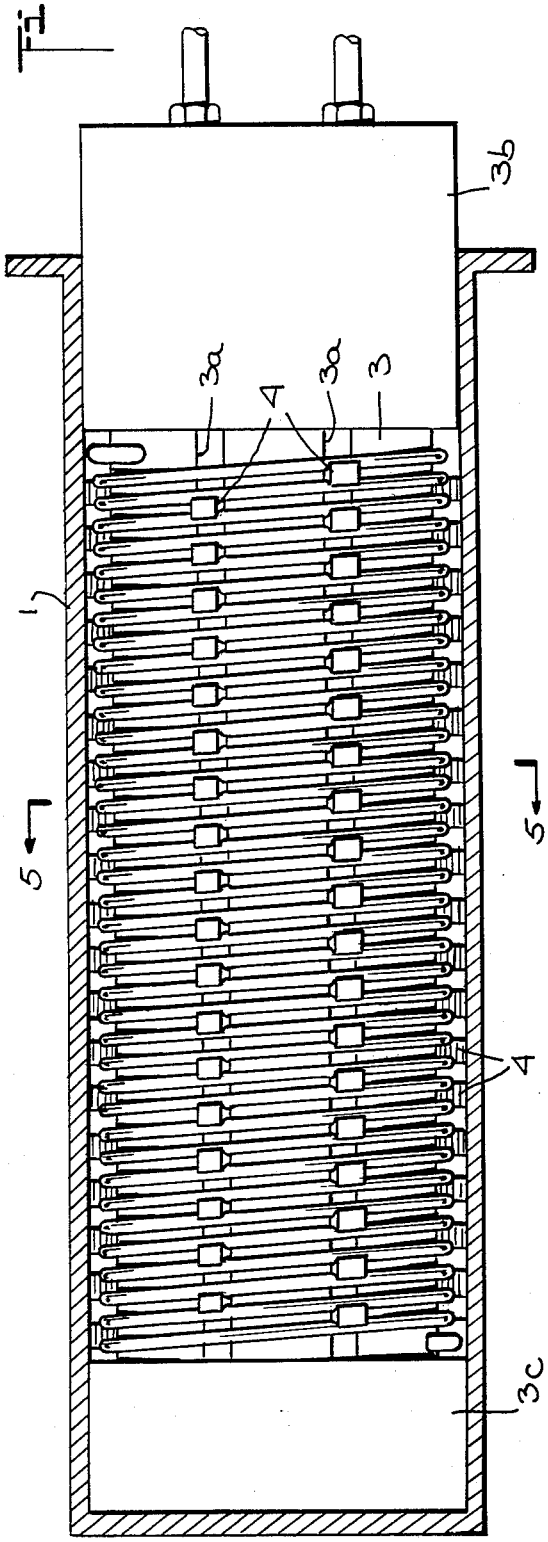
FIG. 1 is a longitudinal section of an electric resistance heater of the tubular type which radiates heat outwardly into a furnace.

Having reference to the above drawings, FIG. 1 shows a typical industrial radiant tubular heater casing 1 made of suitable metal or ceramic and which must be internally heated to perform its function.

The electric resistance heating wire, which may be of any suitable composition, often of large diameter or heavy gauge, as illustrated by FIGS. 2 and 3 is first coiled by normal coiling techniques to form a helical coil of convolutions 2 which interconnect or almost intercontact each other. Preferably the core 3 is inserted into this coil, the core being somewhat longer than the axial length of the coil. It is between the coil convolutions that the inserts 4 are to be inserted as represented by FIG. 3.

For this insertion, the coil of convolutions 2 is axially stretched by suitable stretching force so as to open the coil convolutions, or separate them from each other, far enough to permit the radial inward insertion of the inserts 4 so as to produce the result illustrated by FIG. 4.

With the core 3 having axially extending grooves 3*a*, it is preferable to first insert the core into the coil because the insertion of the spacers 4 in registration with these grooves 3*a* is then facilitated.

Each of the spacers 4 is formed with opposite indents 4*a* in which the convolution wire can nest, and have inner bases 4*b* which extend radially inwardly for extents greater than the depths of the grooves 3*a* so that the coil convolutions are spaced radially away from the core 3. Outwardly the spacers should have external bases 4*c* which extend far enough outwardly so that when the heating element is used inside of a tubular casing as indicated at 1, the spacers space the coil away from the casing's inside.

The exact arrangement of the spacers is immaterial in so long as they perform their intended function. Using the grooved core, the spacers are positioned in rows coinciding with the core grooves, but as to adjacent rows, the spacers can be alternately offset from each other.

It can be seen from the shape of the spacers, which may vary providing equivalent portions are used, that they can be extruded from a ceramic composition into long lengths which are successively cut into the short lengths required and then fired. The ceramic or refractory composition used should be of high purity to avoid chemical reactions with the electric resistance wire. However, the core itself and the casing 1 if made of ceramic material is material selected only for its refractory properties. This permits the use of much less expensive refractory materials. The coil is completely spaced from these components. Another advantage is that excepting for the small contact areas between the spacers and the wire, the latter is completely free from contact so that its entire circumferential surface can function as a radiator which it cannot do when embedded in core grooves in the usual fashion. The small mass of the spacers does not substantially affect the heat radiation from the otherwise freely exposed wire convolutions.

To form a practical heating element, the core 3 is illustrated as being tubular because this cuts down on the amount of refractory required. At opposite ends the wire coil is bent and extended in the same directions to form terminal leads 2*a*, which at one end of the heater are extended through holes formed in a ceramic plug 3*b* pushed into the end of the tubular core, a solid ceramic plug 3*c* being pushed into the other end of the core. This is only to represent a possible heater construction.

It is to be emphasized that both the core and the casing 1, if ceramic, need not be made of material that will not react with the wire; only the spacers need to be made of such material and these require very little material as compared to that needed for the core and casing.

Figure 6:
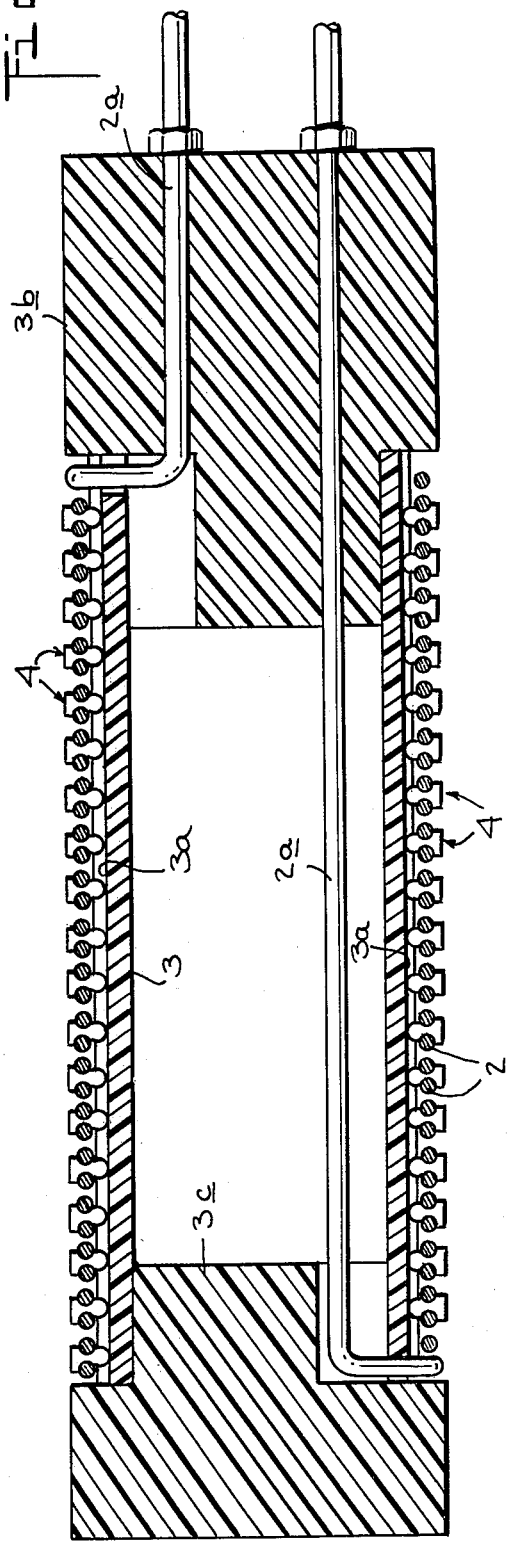
FIG. 6 is a longitudinal section of the coil assembly illustrated by the other views and prior to its being installed in the tubular casing as shown by FIG. 1.

The two terminal leads 2*a*, shown particularly well by FIG. 6, can be made of much heavier gauge wire than the wire from which the heating coil is formed, so that these terminal leads do not represent any great heat loss concerning radiation directed outwardly.

Although the coil assembly of the present invention may be used with different gauges or diameters of wire, the wire thickness should be adequate to provide enough resiliency to hold the spacers firmly pinched in position at least insofar as minimum wire thickness is concerned. All of the electric resistance wire alloys commonly used are elastic metals so that when tightly coiled, a mechanical helical extension spring is simulated. When stretched, such a coil springs back with its convolutions intercontacting or almost so. Therefore, there is an inherent resilient force available for pinching and holding the spacers firmly in position particularly when wire diameters necessarily used inside of tubular industrial radiant heaters are concerned.

The rapid assembly possibilities involved by this invention should be apparent. The coil of wire is coiled as usual on a coiling machine producing tight and preferably intercontacting coil convolutions. The coil can even be made with an initial tension produced by partially overlapping the wire as it is fed onto the coiling mandrel, the resulting coil having convolutions which are held together under tension as contrasted to merely intercontacting. After making the coil, the coil center can be simply slipped through the coil, the coil stretched by adequate tension, the spacers inserted, possibly using jigs for insertion, and the axial tension of the coil then being relieved. The coil convolutions then spring together and firmly pinch the spacers so they are held positively against displacement. By using the grooved core, axial alignment of the circumferentially interspaced rows of spacers is assured. In addition, the spacers are positively held by the grooves against circumferential displacement which might possibly otherwise occur even though the spacers are firmly locked against radial displacement. The core need not be made of material that is mechanically extremely rigid, it being possible to use a core produced by vacuum-forming techniques from a slurry of refractory fibers, this applying also to the core end plugs illustrated if the core is made tubular. Compositional compatibility with the wire at high temperatures is not important, excepting in the case of the spacers themselves.

What is claimed is:

1. A tubular radiant heater electric resistance heating coil assembly comprising a core made of a refractory, and a helical extension spring coil of electric resistance heating wire having convolutions resiliently urged towards each other and held apart by spacers pinched between the convolutions, said spacers having indents engaged by said convolutions and having internal bases engaging said core and spacing the coil radially from the core and the spacers having external bases projecting radially from the coil and adapted to radially space the coil assembly from the inside of a tubular radiant heater casing, said spacers being each integrally made of a refractory that is substantially non-reactive with said resistance wire at high temperatures.

2. The assembly of claim 1 in which said core has longitudinally extending, circumferentially interspaced recesses in which said external bases fit so as to hold the spacers against circumferential displacement.

3. The assembly of claims 1 or 2 in which the refractory of which said core is made is reactive with said resistance wire at said high temperatures.

* * * * *